United States Patent [19]

Hirai et al.

[11] Patent Number: 4,801,961

[45] Date of Patent: Jan. 31, 1989

[54] IMAGE FORMING APPARATUS

[75] Inventors: Hiroyuki Hirai; Hiroshi Hara, both of Kanagawa, Japan

[73] Assignee: Fuji Photo Film Co., Ltd., Kanagawa, Japan

[21] Appl. No.: 67,041

[22] Filed: Jun. 29, 1987

[30] Foreign Application Priority Data

Jun. 27, 1986 [JP] Japan ..... 61-151215

[51] Int. Cl.[4] ..... G03D 9/00; G03D 5/06

[52] U.S. Cl. ..... 354/303; 354/305; 354/318; 354/324; 210/251; 210/687; 250/319; 430/203

[58] Field of Search ..... 354/301, 303, 305, 317, 354/318, 324; 430/203, 403; 210/251, 638, 687, 263; 250/317.1, 318, 319

[56] References Cited

U.S. PATENT DOCUMENTS

| | | | |
|---|---|---|---|
| 3,733,994 | 5/1973 | Armstrong et al. | 354/324 |
| 4,083,782 | 4/1978 | Kunin | 210/687 |
| 4,430,415 | 2/1984 | Aono et al. | 430/203 |
| 4,483,914 | 11/1984 | Naito et al. | 430/203 |
| 4,500,626 | 2/1985 | Naito et al. | 430/203 |
| 4,503,137 | 5/1985 | Sawada | 430/203 |
| 4,620,096 | 10/1986 | Takehara et al. | 250/317.1 |
| 4,629,675 | 12/1986 | Takehara et al. | 354/303 |

*Primary Examiner*—A. A. Mathews

*Attorney, Agent, or Firm*—Sughrue, Mion, Zinn, Macpeak & Seas

[57] ABSTRACT

An image forming apparatus for obtaining a dye image on an image receiving material by applying an image forming solvent to a heat development photosensitive material and/or the image receiving material comprises: a solvent application device for applying the solvent to the heat development photosensitive material and/or the image receiving material to circulate and reuse the solvent; and a cation exchanger and/or a pollutant adsorbent disposed in the solvent application device so as to come into contact with the solvent. Accordingly, since $Ca^{2+}$ ions, $Mg^{2+}$ ions, etc., can be removed, the apparatus effectively prevents the fouling of the solvent.

14 Claims, 5 Drawing Sheets

IMAGE FORMING APPARATUS

BACKGROUND OF THE INVENTION

Field of the Invention

The present invention relates to an apparatus for forming a dye image on an image receiving material by transferring a movable dye image formed on a heat developed photosensitive material onto the image receiving material in the presence of an image forming solvent.

Description of the Prior Art

As shown in Japanese Patent Laid-Open No. 75247/1984, an image forming apparatus for obtaining a color image by a heat developed photosensitive material is known in which, after an image is exposed on a heat developable photosensitive material, the photosensitive material is moved to a heat development section, and a movable dye is transferred onto an image receiving material by causing the image receiving material to adhere to the heat-developed photosensitive material, thereby obtaining a dye image. Furthermore, Japanese Utility Model Application No. 116734/1986 discloses an apparatus in which an exposed heat developable photosensitive material is adhered to an image receiving material and is subjected to heating, so that heat development and transfer of the dye are effected simultaneously.

An image forming solvent such as water is applied to the photosensitive material and/or the image receiving material prior to the transfer process or the heat development process so as to accelerate the transfer of the dye or the development.

This image forming solvent is supplied to the photosensitive material and/or the image receiving material by any of various methods such as one in which roller application or wire bar application is used, as disclosed in Japanese Patent Laid-Open No. 181353/1984, one in which a water absorbent member is used, as disclosed in Japanese Patent Laid-Open No. 181354/1984, one based on bead application as disclosed in Japanese Patent Laid-Open No. 181346/1984, one based on bead application using a water repellant roller, as disclosed in Japanese Patent Laid-Open No. 181348/1984, or a method involving dip application.

In order to effectively use the image forming solvent, the image forming solvent is circulated between a solvent supplying section, such as a section which effects the aforementioned application, and a solvent storage section.

However, if the image forming solvent is reused by circulating it, as described above, gelatine and other components are exfoliated or eluted from the photosensitive material and/or the image receiving material into the solvent, depending on the frequency of use. Consequently, fungi and bacteria are likely to be produced, with the result that the solvent becomes contaminated. If such contamination occurs, a problem arises in that the device which supplies the solvent becomes contaminated and impedes the supply of the solvent, or the contaminants are interposed between the photosensitive material and the image receiving material, thereby hampering the development or transfer.

SUMMARY OF THE INVENTION

Accordingly, an object of the present invention is to provide an image forming apparatus which does not hamper development or transfer nor impede the supply of solvent, by restricting the development of fungi and bacteria even if the image forming solvent is circulated and reused over extended periods of time, thereby overcoming the above drawback of the prior art.

To this end, according to the present invention, there is provided an image forming apparatus for obtaining a dye image on an image receiving material by applying an image forming solvent to a heat developable photosensitive material and/or the image receiving material, the apparatus comprising: a solvent application device for storing the image forming solvent and applying the solvent to the photosensitive material and/or the image receiving material; and a cation exchanger and/or a pollutant adsorbent disposed in the solvent application device so as to come into contact with the solvent.

The present invention according to one aspect thereof is based on the discovery that fungi and bacteria are likely to propagate in the presence of cations such as $Ca^{2+}$ ions, $Mg^{2+}$ ions, or $Fe^{3+}$ ions.

In the present invention, since any $Ca^{2+}$ ions, $Mg^{2+}$ ions, or heavy metal ions that have accumulated in the image forming solvent are removed by an ion exchanger, the development of fungi and bacteria can be restricted, so that the solvent application device is not contaminated, the supply of the solvent is not impeded, development or transfer is not hampered, and dye images of excellent image quality can constantly be obtained.

In the present invention, treatment is effected by bringing the solvent into contact with a cation exchanger in order to remove $Ca^{2+}$ ions, $Mg^{2+}$ ions, $Fe^{3+}$ ions and other heavy metal ions contained in the image forming solvent.

The shape of the cation exchanger used in the present invention is not particularly restricted; it is possible to use a cation exchanger which is in the form of granules, fibers, a membrane, a tube, pellets, or the like. The cation exchanger can be a high polymer substance such as a cation exchange resin, a cation exchange membrane, an adsorbent resin, or a chelate resin. However, a cation exchange resin is particularly preferable from the view point of removing $Ca^{2+}$ ions and heavy metal ions. The cation exchange resin can be of a polystyrene-based strong acid type, a polystyrene-based weak acid type, a polyacrylate-based weak acid type, or a polymethacrylate-based weak acid type. However, a strong acid type is preferable, and a cation exchange resin which is based on polystyrene or polystyrene/divinylbenzene and has a sulphonate group, or the like, as an exchange active group is particularly preferable.

These cation exchange resins may be of a gel type or a porous type. A cation exchange resin having any desired degree of crosslinking can be used. Examples of the cation exchange resin that can be used in the present invention include Diaion SK-1B, Diaion PK-216 (Mitsubishi Chemical Industries, Ltd.) Amberlite IR-120B (Organo), and Dowex 50W (Muromachi Kagaku). A commercially available Na type cation exchange resin can be used as it is, but it is also possible to use the same after subjecting it to a suitable pretreatment, thereby converting it into an Li type, K type, or similar resin.

In addition, an H type cation exchange resin may also be used. In this case, however, since the pH of the solvent drops, it is preferable to use this type of cation exchange resin together with an OH type of anion exchange resin. The method of using the cation exchanger is not particularly restricted, and it suffices if the image forming solvent is capable of substantially contacting the cation exchanger. The cation exchanger may be used by, for instance, laying it inside a circulating tank, or by charging it into a column and allowing the image forming solvent to pass through the column.

The amount of cation exchanger used in the present invention cannot be specifically limited since it depends on factors such as the ion exchange capacity of the cation exchanger, the amount of $Ca^{2+}$ ions, $Mg^{2+}$ ions, and other heavy metal ions in the solvent of the photosensitive material, and the temperature of the solvent. However, the amount used must be such that the amounts of each of the $Ca^{2+}$ ions, $Mg^{2+}$ ions, and other heavy metal ions become 5 mg/l or less, preferably 3 mg/l or less.

In addition, the present invention is also based on the discovery that since components that elute from the sensitized material and/or the image receiving into the image forming solvent various kinds such as inorganic substances, organic substances, and colloidal particles, an adsorbent is effective in order to remove them.

In the present invention, since inorganic substances, organic substances, colloidal particles, etc., are adsorbed by an adsorbent, the development of fungi and bacteria can be checked without causing a change in properties. Therefore, it is possible to constantly obtain die images of good quality on a stable basis since the solvent supplying device does not become contaminated, the supply of the solvent is effected without impediment, the development or transfer is not hampered, and there is no need to replace the solvent in continuous operation for extended periods of time.

In the present invention, treatment is effected by bringing the adsorbent and the solvent into contact with each other with a view to removing inorganic substances, organic substances, colloidal particles, etc., that have eluted into the image forming solvent.

As for the adsorbent employed in the present invention, its shape is not particularly restricted, and powders, granules, fibers, pellets, etc. can be used. As for the material of the adsorbent, active carbon, acidic clay, synthetic zeolite, etc., may be used, and active carbon is particularly preferable in that it efficiently adsorbs inorganic substances, organic substances, and colloidal particles.

In the present invention, the adsorbent may also be used in conjunction with the aforementioned cation exchange resin.

In the present invention, an anion exchange resin, active carbon, or zeolite may also be used to remove anionic substances and organic substances eluted from the sensitized material.

The image forming apparatus to which the present invention is applied may be arranged so that the heat development section for an exposed heat development photosensitive material can be provided separately from a transfer section heating the heat-developed photosensitive material and an image receiving material by superposing them on each other and for transferring an image onto the image receiving material. Alternatively, the image forming apparatus may be arranged so that the heat development section and the transfer section are disposed in the same place, namely, a heat development and transfer section can be provided in which heating is effected by superposing the exposed photosensitive material to the image receiving material, so that heat development and heat transfer can be effected simultaneously.

In addition, in the image forming apparatus to which the present invention is applied, heat developable photosensitive materials (heat developable photosensitive elements) and image receiving materials (dye fixing elements) such as those disclosed in U.S. Pat. Nos. 4,430,415, 4,483,914, 4,500,626, and 4,503,137, and Japanese Patent Laid-Open Nos. 154,445/1984, 165,054/1984, 180,548/1984, 218,443/1984, and 120,356/1985, Japanese Patent Application Nos. 209,563/1984, 79,709/1985, 169,585/1985, and 244,873/1985 can be used.

In the present invention, the image forming solvent is a solvent necessary for image formation, and includes, for instance, water, a low-melting point organic solvent (alcohol, ketones, amides, etc.), or a solvent in which various additives such as a surface active agent, a development accelerator, and a development inhibiting agent are added.

DESCRIPTION OF THE PREFERRED EMBODIMENTS

First Embodiment

Description will now be made of an image forming apparatus to which the present invention is applied, taking by way of example a case in which heat development and heat transfer are effected simultaneously.

Figure 2:
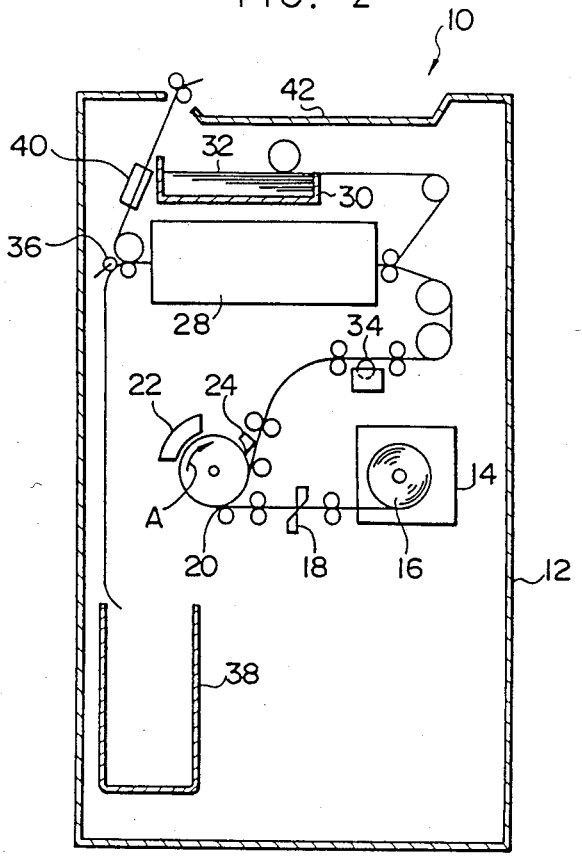
FIG. 2 is a cross-sectional view of an image forming apparatus to which this water application section is applied.

FIG. 2 shows an image forming apparatus 10 in accordance with this embodiment.

In this image forming apparatus 10, a magazine 14 is mounted on a housing 12 to accommodate a heat developable photosensitive material 16. The photosensitive material 16 in the magazine 14 is withdrawn from an outer periphery thereof, is cut to a predetermined length by a cutter 18, and is subsequently wound around the outer periphery of an exposure drum 20 (in the direction of the arrow A in FIG. 2). An exposure head 22 is disposed about part of the outer periphery of exposure drum 20. After the exposure, the exposure drum 20 rotates reversely, so that the photosensitive material 16 is scraped off by a scraper 24. The photosensitive material 16 is then wet with water at a water application section 34 which serves as a solvent application device, and is sent to a heat development and transfer section 28.

Meanwhile, image receiving paper 32 accommodated in a tray 30 is sent to the heat development and transfer section 28, and after it is superposed on the photosensitive material 16, the image receiving paper 32 and the photosensitive material 16 are heated by a heater disposed in the heat development and transfer section 28. Consequently, the photosensitive material 16 is developed, and a developed image is transferred onto the image receiving paper 32.

After completion of the transfer, the photosensitive material 16 is accommodated in a disposal tray 38 via a release section 36, while the image receiving paper 32 is delivered to a take out tray 42 via a drying section 40.

Figure 1:
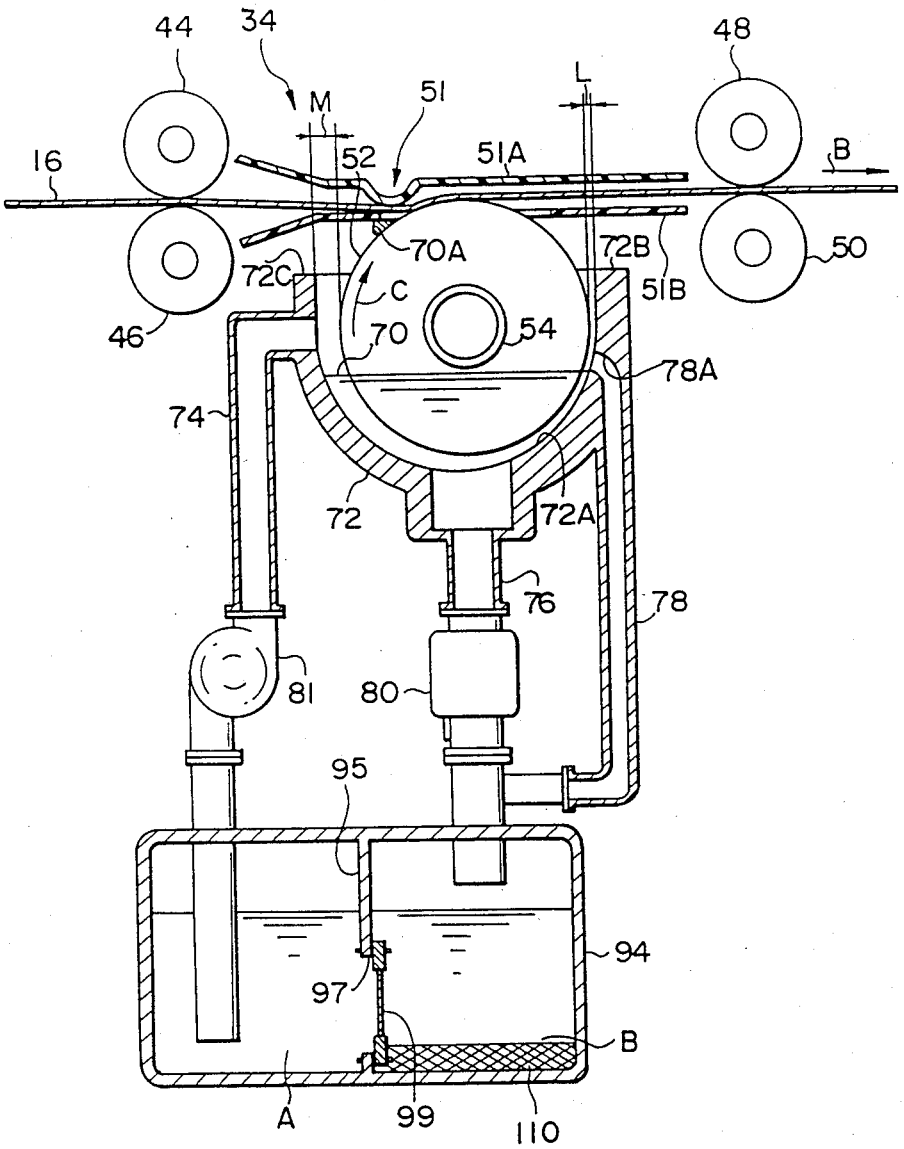
FIG. 1 is a cross-sectional view of a water application section in accordance with an embodiment of the present invention.

As shown in FIG. 1, a pair of conveying rollers 44, 46 for clamping the photosensitive material 16 being conveyed are disposed in the water application section 34. A pair of conveying rollers 48, 50 are disposed downstream of the conveying rollers 44, 46 in such a manner as to clamp and convey the photosensitive material 16.

These rollers are adapted to feed the photosensitive material 16 to the heat development and transfer section 28 in the direction of the arrow B by receiving the driving force of a motor (not shown). In addition, guide plates 51A, 51B are disposed between these pairs of conveying rollers such as to be coextensive with to both side ends of the photosensitive material 16 being conveyed and are adapted to guide the photosensitive material 16 from the conveying rollers 44, 46 to the conveying rollers 48, 50.

A solvent supplying section 51 is disposed between the conveying roller 46 and the conveying roller 50 so as to correspond to the central portion of the rear surface (the exposed surface side) of the photosensitive material 16. This solvent supplying section 51 has an application roller 52 which serves as an application member (means). This application roller 52 has its rotary shaft 54 axially supported by the housing 12. In addition, a motor (not shown) is coupled with this rotary shaft 54 via a gear (not shown), and the application roller 52 is adapted to be rotated in the direction of the arrow C by the driving force of this motor.

A part of the application roller 52 immersed in water 70, i.e., an image forming solvent, in a tank 72, and is adapted to draw up water 70 at its peripheral surface during rotation.

Water 70 which has been drawn up by the application roller 52 forms a bead 70A between the application roller 52 and the photosensitive material 16. In this state, water to be applied to the rear surface of the photosensitive material 16 is formed in correspondence with the conveyance of the photosensitive material 16.

The main tank 72 for receiving water 70 is provided with a supply pipe 74 for supplying water 70 and an overflow pipe 78 for discharging excess water 70. A pump 81 is installed in an intermediate portion of the supply pipe 74. An opening 78A of the overflow pipe 78 is disposed at a predetermined height from a bottom surface 72A of the main tank 72, and the arrangement is such that when water 70 supplied from the supply pipe 74 has reached a level higher than this opening 78A, water 70 is discharged from the main tank 72 so as to maintain the volume of water (water level) inside the main tank 72 at a fixed level.

Incidentally, the water level of the main tank 72 is preferably of such a height that approximately one third of the application roller 52 is immersed.

In addition, as shown in FIG. 1, the application roller 52 is disposed in such a manner that the gap (the dimention L in FIG. 1) between the outer periphery of the application roller 52 and a right-hand wall 72B of the main tank 72 is smaller than the gap (the dimension M in FIG. 1) between the application roller 52 and a left-hand wall **72*c* of the main tank 72**.

This arrangement makes it possible not to create a gap in the water level between the left-hand and right-hand water levels of the application roller 52 due to the rising of water 70 during the rotation of the application roller 52. Incidentally, it is necessary to allow for 2 mm or above for the aforementioned dimension M, and, particularly, it is preferable to allow for approximately 3 mm. Thus, the main tank 72, the application roller 52, etc. constitute the solvent application section.

Meanwhile, the end portions of the supply pipe 74 and the overflow pipe 78 are respectively connected to a circulating tank 94 which serves as a solvent storage section, so as to allow water 70 to be circulated for reuse.

The circulating tank 94 is partitioned by a partition wall 95 into two chambers of a supply-side water tank A and a return-side water tank B at a substantially central portion thereof. This partition wall 95 has an opening 97, and a filter 99 is installed in such a manner as to cover the opening 97. In addition, a cation exchanger 110 is inserted to the water tank B.

The overflow pipe 78 is installed in such a manner that its end portion is located above the water level of the water tank B, and is arranged so as to prevent pollutant substances from flowing reversely (i.e., returning) into the main tank 72 through water 70.

The operation of the first embodiment will be described hereafter.

The photosensitive material 16 accommodated in a cassette 14 is cut to a predetermined length and is then wound around the exposure drum 20, and is sent to the water application section 34 after being exposed by the exposure head 22.

The application roller 52 rotates in the ,direction of the arrow C in FIG. 1, draws out water 70 from the main tank 72 by absorbing it into its surface, and forms the bead 70A between the application roller 52 and the rear surface (the emulsion surface) of the photosensitive material 16, said bead 70A being applied to the rear surface of the photosensitive material 16.

When the rear-end portion of the photosensitive material 16 passes the application roller 16, the bead 70A is returned to the main tank 72 by its own weight.

The photosensitive material 16 to which water has been applied in the water application section 34 is sent to the heat development and transfer section 28. The image receiving paper 32 withdrawn from the tray 30 is sent to the heat development and transfer section 28, and is superposed on the photosensitive material 16. At this stage, heating and development are carried out in the presence of water, and, at the same time, a color image is heat-transferred onto the transfer surface of the image receiving paper 32. In this state, since the necessary amount of water has already been applied to the photosensitive material 16, extremely good development and transfer operations are carried out.

The photosensitive material 16 and the image receiving paper 32 in the adhered state after transfer are sent from the heat development and transfer section 28 to the release section 36, where the photosensitive material 16 is delivered to the disposal tray 38, while the image receiving paper 32 is sent to the take out tray 42 via the drying section 40.

In the image forming apparatus 10 to which the present invention is applied, water is circulated between the main tank 72 and the circulating tank 94 via the supply pipe 74 and the overflow pipe 78 so as to be reused. In addition, a filter 99 and a cation exchanger and/or a pollutant adsorbent 110 are provided in the circulating tank 94 so as to remove binder chemicals, colloidal particles and other impurities, as well as cations such as $Ga^{2+}$ ions and the like.

This filter 99 is not particularly restricted, but it is preferable to employ one which allows a solvent such as water 70 to have a permeation rate 0.1 $l/m^2$ hour in the presence of a pressure differential of 1 atmosphere and which will not allow substances of an average length of 120 μm or above to pass therethrough. As such a filter 99, it is possible to use that described in "Synthetic Polymer Membrane" by R. Kesting (published by McGraw-Hill, Inc.), that described in "Method of Separation Using Membrane" compiled by Bunji Hagiwara and Koichi Hashimoto (published by Kodansha Ltd.), and the like. More specifically, it is possible to use a fine porous membrane formed of nylon mesh or non-woven fabrics, a cellophane membrane, a collodion membrane, a denitrated collodion membrane, a wet regenerated cellulose membrane, parchment paper, a polyvinyl alcohol membrane, a bacteria cellulose membrane, a fatty membrane ,or a semipermeable membrane such as a biomembrane.

The above-mentioned filter removes impurities contained in water, i.e., photographic additives such as gelatine, dust carried from the air by means of the photosensitive material and/or the image receiving material, so that water circulated and supplied to the main tank is always kept clean. In addition, the filter 99 also serves to prevent the cation exchanger 110 from being sucked up by the pump 81.

Furthermore, in the first embodiment shown in FIG. 1, the discharge pipe 76 for discharging the water of the main tank 72 is provided on the bottom portion of the main tank 72, and adapted to allow a valve 80 to be opened periodically to discharge all the water contained in the main tank 72. The other end of the discharge pipe 76 converges with the overflow pipe 78. This arrangement makes it possible to remove impurities that are deposited in the main tank 72 and are difficult to overflow.

Although, in the above-described first embodiment, the filter 99 was installed at the opening 97 of the partition wall 95 provided in the circulating tank 94, the position and the configuration of the filter 99 should not be restricted to those described above, and it suffices if the position and the configuration are such as to be capable of preventing the cation exchanger from being sucked up by the pump 81.

In cases where the cation exchanger is a cation exchange membrane, this cation exchange membrane can also serve as the filter 99. In this case, the cation exchange membrane (filter) 99 is not restricted to this place, but may be incorporated elsewhere in the circulating system for water 70. For instance, it may be installed in a water intake port of the supply pipe 74 or upstream of the convergence point of the overflow pipe 78 and the discharge pipe 76. However, it is necessary to ensure that the impurities filtered out by the cation exchange membrane 99 will not return to the main tank 72. For this purpose, the same arrangement as that used in the first embodiment shown in FIG. 1 may be provided so that overflowing liquid and discharged liquid from the main tank 72 will not flow backward.

In addition, although, in the foregoing first embodiment, description has been made of cases where water is applied to the photosensitive material 16 in accordance with the present invention, the invention can similarly be applied to cases where water is applied to the image receiving paper 32.

Experimental Example A

A photosensitive material and a dye fixing material (image receiving material) A such as described in a first embodiment of Japanese Patent Publication (OPI) No. 953/1987 were prepared. The two materials were respectively set in the image forming apparatus shown in FIG. 2. The water application section 34 of this image forming apparatus is arranged as shown in FIG. 1. The water application roller 52 has a diameter of 50 mm, and its speed is 400 r.p.m. The drive of the supply pump 89 and the height of an inlet port 78A of the overflow pipe are adjusted and set in such a manner that 20 to 30 cc of water is constantly kept in the main tank 72. Approximately 0.6 to 1.5 g of water is applied by this water application roller to the application surface of photosensitive material cut to a size of 30 cm×30 cm.

The circulating tank 94 is provided with a supply-side water tank A and a return-side water tank B, each being adapted to contain 2l of water. The partition wall between the water tanks A and B has an opening of 30 mm×30 mm, where a 100 μm nylon mesh is installed.

With the above-described arrangement, an experiment was conducted in which 50 sheets (30 cm×30 cm) of photosensitive material were treated a day at a room temperature of 25° C. to 30° C., for a period of 60 days with respect to the case (test A-1) where the cation exchange resin was not placed in the water tank B and the case (test A-2) where 25 ml of the cation exchange resin Diaion PK-216 (Mitsubishi Chemical Industries, Ltd.) was added. The results obtained after the lapse of 60 days are shown below.

Test A-1

The water of the water tank B turned yellow and issued a foul smell. Also, jelly-like sludge with fine dust and sand-like substances mixed therein was deposited on the bottom of the water tank. In addition, a sludgy smudge was observed to have attached to the roller 52 as well, and scratches and uneven distribution of water were found on the wetted surface of the photosensitive material.

As for the water tank A, although some sludgy substance was observed, most of it was clean. A small amount of uneven distribution of water was observed on the wetted surface of the photosensitive material, but no scratches were found.

Test A-2

The water in both of the water tanks A and B was only slightly yellowish and no sludgy substance was observed. No scratches or uneven distribution of applied water were observed on the wetted surface of the photosensitive material.

In addition, no smudge was observed on the water application roller in Test A-2.

Experimental Example B

With the arrangement of Example A, an experiment was conducted in which 50 sheets (30 cm×30 cm) of the photosensitive material were treated per day at a room temperature of 25° C.–30° C. for a period of 60 days with respect to the case (Test B-1) where an adsorbent was not placed in the return-side water tank A and the case (Test B-2) where active carbon was placed in the return-side water tank A. The results obtained after the lapse of 60 days are shown below.

Test B-1

(1) The water of the supply-side water tank B turned brown and issued a foul smell. Also, jelly-like sludge with fine dust and sand-like substances mixed therein was seen to have deposited on the bottom of the water tank. In addition, a sludgy smudge was observed to have attached to the roller 52 as well, and scratches and uneven distribution of water were found on the wetted surface of the photosensitive material.

As for the water tank A, although some sludgy substance was observed, most of it was clean. A small amount of uneven distribution of water was observed on the wetted surface of the photosensitive material, but no scratches were found.

Test B-2

(2) The water in both of the return- and supply-side water tanks A and B was clean, and no sludgy substance was observed. No scratches or uneven distribution of were observed on the surface of the photosensitive material.

In addition, no smudge was observed on the water application roller in Test 2.

Figure 3:
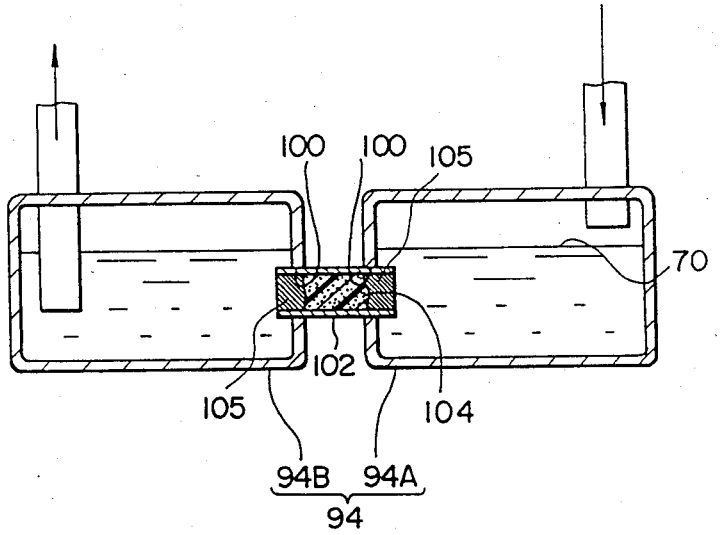
FIG. 3 is a cross-sectional view of a tank in accordance with a second embodiment.

A second embodiment in accordance with the present invention will be described hereafter. Incidentally, in this second embodiment, the overall arrangement of the water application section 34 is the same as that of the first embodiment, and so description of its structure will be omitted, and description will be made only of the circulating tank 94 with reference to FIG. 3.

The circulating tank 94 comprises a first tank 94A disposed on the upstream side and a second tank 94B disposed on the downstream side. Concentric circular holes 100 are respectively provided on opposed side surfaces thereof. A cylindrical body 102 is provided in these circular holes such as to span the two circular holes and to allow the first and second tanks 94A and 94B to be communicated with each other. A cation exchange resin (e.g., Diaion SK-1B) and/or a pollutant adsorbent 104 is accommodated in the cylindrical body 102. Circulating water 70 is adapted to reach the second tank 94B from the first tank 94A after passing through this cation exchange resin and/or the pollutant adsorbent 104. Two pieces of sponge 105 are respectively inserted to abut against the opposite ends of the cation exchange resin so as to retain the cation exchange resin.

Namely, this cation exchange resin and/or the pollutant adsorbent 104 functions to remove $Ca^{2+}$ ions, organic substances, and the like contained in water 70 discharged from the mai tank 72 (refer to FIG. 1).

Description will now be made of the operation of the second embodiment.

In this second embodiment, since the cation exchanger and/or the pollutant adsorbent is formed separately from the first and second tanks 94A, 94B, the replacement of the cation exchange membrane and/or the pollutant adsorbent 104 can be faciliated in comparison with the first embodiment In addition, since the cylindrical body 102 can be have any desired length, the first and second tanks 94A and 94B may not necessarily be disposed adjacent to each other.

Figure 4:
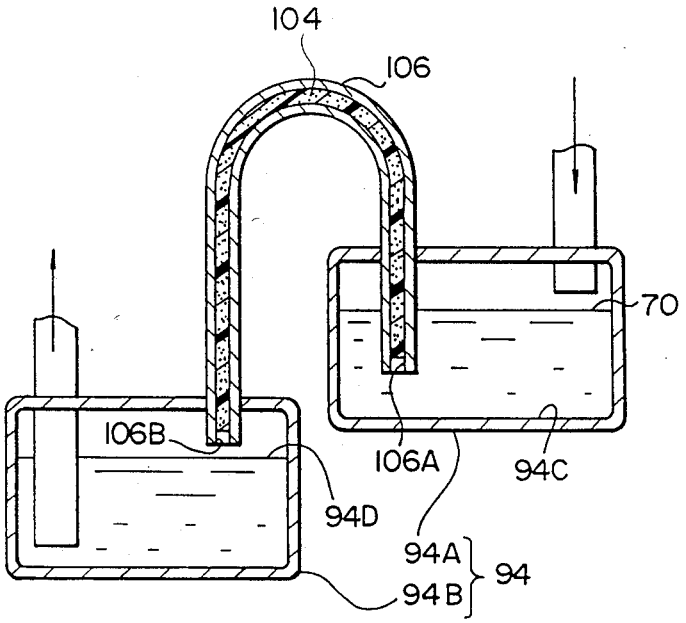
FIG. 4 is a cross-sectional view of a tank in accordance with a third embodiment.

FIG. 4 shows a third embodiment of an image forming apparatus in accordance with the present invention.

A vertical gap is formed between the first tank 94A and the second tank 94B, and the arrangement is such that a bottom portion 94C of the first tank is set higher than the water level 94D of water 70 stored in the second tank.

One end portion of a U-tube 106 is accommodated in the first tank 94A, and an opening thereof, which is disposed in the water facing downwardly serves as a flow inlet port 106A. Meanwhile, the other opening is disposed above the water level of the second tank 94B and below the level of the flow inlet port 106A and serves as a flow outlet port 106B.

The cation exchange resin and/or pollutant adsorbent 104 shown in the second embodiment and, as necessary, a porous member such as sponge or absorbent cotton are accommodated in the U-tube 106. The arrangement is such that water 70 can be moved from the first tank 94A to the second tank 94B by making use of the capillarity of these members.

Description will now be made of the operation of the third embodiment.

Water 70 stored in the first tank 94A is sucked out by the cation exchange resin and/or pollutant adsorbent 104 or the like accommodated in the U-tube 106 from the flow inlet port 106A. The water 70 is sucked up by virtue of the capillarity of the cation exchange resin and/or pollutant adsorbent 104 or the like, reaches the flow outlet port 106B, and moves to the second tank 94B.

Since the flow outlet port 106B is disposed so as to be located above the water level of the second tank 94B and below the level of the flow inlet port 106A, water 70 will not flow backward from the second tank 94B to the first tank 94A.

In addition, replacement work can be extremely facilitated since the U-tube alone will need to be replaced.

Figure 5:
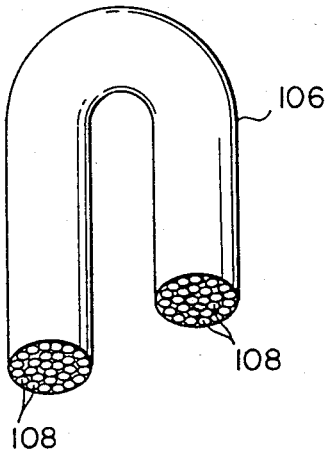
FIG. 5 is a perspective view of a U-tube which is filled with cation exchange membranes and/or pollutant adsorbents.

It should be noted that the cation exchangers employed in the second and third embodiments are not restricted to the cation exchange resin 104 and the like, and an arrangement may also be provided such that, as shown in FIG. 5, the U-tube 106 is tightly packed with cation exchange membranes formed into capillary tubes 108.

Incidentally, although, in the foregoing embodiments, description has been made of cases where the solvent circulates, the present invention is not restricted to this situation and can be applied to any apparatus in which the solvent is reused.

As described above, an image forming apparatus in accordance with the present invention is arranged such that the image forming solvent is made to circulate between the solvent supplying section and the solvent storage section, and an ion exchanger and/or a pollutant adsorbent is interposed in this circulating system. Accordingly, the image forming apparatus has advantages in that, even if the image forming solvent is circulated and reused for extended periods of time, no hindrance is caused to the supply of the solvent, and development or transfer is not hampered.

What is claimed is:

1. In an image forming apparatus for obtaining an image on an image receiving material by applying an image forming solvent to at least one of a photosensitive material and said image receiving material, the improvement comprising:

a solvent application device including means for storing said image forming solvent and applying said solvent to at least one of said photosensitive material and said image receiving material; and at least one of a cation exchanger and a pollutant absorbent disposed in said solvent application device so as to come into contact with said solvent.

2. An image forming apparatus according to claim 1, wherein said solvent application device includes a solvent application section for applying said solvent to said photosensitive material or said image receiving, material, a solvent storage section for storing said solvent, and circulating means for circulating said solvent between said solvent application section and said solvent storage section.

3. An image forming apparatus according to claim 2, wherein said at least one of said cation exchanger and said pollutant adsorbent is disposed in said solvent storage section.

4. An image forming apparatus according to claim 3, wherein said circulating means includes a first pipe for supplying said solvent from said solvent storage section to said solvent application section, a second pipe for returning said solvent from said solvent application section to said solvent storage section, and a pump for circulating said solvent.

5. An image forming apparatus according to claim 4, wherein said solvent storage section has a first chamber connected to said first pipe and a second chamber connected to said second pipe, said first and second chambers communicating with each other via a filter.

6. An image forming apparatus according to claim 5, wherein said at least one of said cation exchanger and said pollutant adsorbent is disposed in said second chamber.

7. An image forming apparatus according to claim 5, wherein said cation exchanger is composed of a cation exchange membrane constituting said filter.

8. An image forming apparatus according to claim 4, wherein said solvent storage section is constituted by a first tank connected to said first pipe, a second tank connected to said second pipe, and a cylindrical body communicating with said first and second tanks, said at least one of said cation exchanger and said pollutant adsorbent being accommodated in said cylindrical body.

9. An image forming apparatus according to claim 4, wherein said solvent storage section is constituted by a first tank connected to said first pipe, a second tank connected to said second pipe, and a U-tube communicating with said first and second tanks and having open end portions oriented toward the bottom surface of each of said tanks, said at least one of said cation exchanger and said pollutant adsorbent being accommodated in said U-tube in such a manner that said solvent can move from said second tank to said first tank by means of capillarity.

10. An image forming apparatus according to claim 1, wherein said cation exchanger is a cation exchange resin.

11. An image forming apparatus according to claim 8, wherein said cation exchanger is a cation exchange resin.

12. An image forming apparatus according to claim 9, wherein said cation exchanger is a cation exchange membrane tightly packed so as to form capillaries.

13. An image forming apparatus according to claim 1, wherein said adsorbent is active carbon.

14. An image forming apparatus for obtaining a dye image on an image receiving material by applying an image forming solvent to at least one of a heat development photosensitive material and said image receiving material, said apparatus comprising:

a solvent application section for applying said solvent to at least one of said heat development photosensitive material and said image receiving material;

a solvent storage section for storing said image forming solvent;

circulating means for circulating said solvent between said solvent application section and said solvent storage section; and at least one of a cation exchanger and a pollutant absorbent disposed so as to come into contact with said solvent.

* * * * *